US005997247A

United States Patent [19]

Arraitz et al.

[11] Patent Number: 5,997,247

[45] Date of Patent: Dec. 7, 1999

[54] SEAL OF STACKED THIN SLABS THAT SLIDE WITHIN RECEPTION SLOTS

[75] Inventors: Anne-Marie Arraitz, Nandy; Eric Stéphan Bil, Combs la Ville; Michel Gérard Paul Hacault, Massy; Laurent Philippe Yves Leray; Marc Roger Marchi, both of Le Mee sur Seine; Didier Marie Mortgat, Combs la Ville, all of France

[73] Assignee: Societe Nationale Détude et de Construction de Mothers d'aviation "Snecma", Paris, France

[21] Appl. No.: 09/006,956

[22] Filed: Jan. 14, 1998

[51] Int. Cl.[6] ..... F16J 15/12

[52] U.S. Cl. ..... 415/139; 415/134; 277/543; 277/654

[58] Field of Search ..... 415/134, 135, 415/136, 137, 138, 139; 277/543, 548, 610, 644, 654, 603, 608

[56] References Cited

U.S. PATENT DOCUMENTS

| | | | |
|---|---|---|---|
| 26,510 | 12/1859 | Miller et al. | 277/610 X |
| 4,063,845 | 12/1977 | Allen | 415/134 |
| 4,268,046 | 5/1981 | Nisper . | |
| 4,311,432 | 1/1982 | Kildea | 415/134 |
| 4,537,024 | 8/1985 | Grosjean | 415/139 X |
| 4,626,002 | 12/1986 | Hagemeister et al. | 277/151 X |
| 4,767,260 | 8/1988 | Clevenger et al. | 416/139 X |
| 5,088,888 | 2/1992 | Bobo | 415/134 X |
| 5,221,096 | 6/1993 | Heldreth et al. | 277/630 |
| 5,645,284 | 7/1997 | Fitton | 277/610 |
| 5,664,791 | 9/1997 | Owen | 277/610 X |
| 5,865,600 | 2/1999 | Mori et al. | 415/135 X |

FOREIGN PATENT DOCUMENTS

| | | |
|---|---|---|
| 525 419 | 8/1972 | Switzerland . |
| 12000609 | 10/1990 | U.S.S.R. . |
| 1 493 913 | 11/1977 | United Kingdom . |

*Primary Examiner*—John E. Ryznic
*Attorney, Agent, or Firm*—Oblon, Spivak, McClelland, Maier & Neustadt, P.C.

[57] ABSTRACT

This seal (6) running between gaps (6) between two stator sectors of a gas turbine engine is made up of several thin flexible slabs, capable of sliding one over the other, which gives a better seal.

2 Claims, 3 Drawing Sheets

SEAL OF STACKED THIN SLABS THAT SLIDE WITHIN RECEPTION SLOTS

BACKGROUND OF THE INVENTION

1. Field of the Invention

The invention relates to a seal, the essential element of which consists of a stack of thin slabs that slide within reception slots.

2. Description of the Related Art

It is designed to span the gaps between pairs of stator sectors of a gas turbine engine: these components being subjected to a high degree of heating during operation, which produces expansions that are sufficiently great that one cannot construct a stator with contiguous sectors. Nevertheless the seal must be restored between the sectors of the stator, which define volumes subjected to different pressures, and notably the flow stream of the gases of the gas turbine engine.

The usual solution consists of hollowing out slots in the sectors separated by the gap and which form a continuation of one another and of inserting a slab of material in the slots and across the gap to span the latter. It is illustrated in many previous documents from which French Patents Nos. 2 452 590 and 2 597 921 will be mentioned in order to quote only designs from the assignee. Such seals allow gas leaks along the gaps to be reduced but even so progress is desirable in order to increase the efficiency of gas turbine engines.

SUMMARY OF THE INVENTION

According to the invention, the relatively thick and rigid slab is replaced by a plurality of thin slabs, simply placed one upon the other, movable within the slots, which allows them to mutually slide. These thin slabs, inevitably thinner than the single slab, are also more flexible. The advantages of this design will be explained below. However it must be noted that the seals made up of thin slabs or superimposed laminae already exist, and have, furthermore been proposed by the assignee and described in French Patent Nos. 2 683 851 and 2 691 749, but in those cases the thin slabs are not free to slide mutually within a pair of slots and neither are they mobile with respect to one another: in the first of these patents, they are compressed in the direction of their length and pressed towards the bottom end of a slot by a smooth surface of a locking piece; in the other, they form part of a dynamic seal, providing the seal between rotor and stator, and they are partially mounted in a seal holder, their free end rubbing against a smooth surface. The conditions for use are therefore different.

BRIEF DESCRIPTION OF THE DRAWINGS

We will now make a concrete description of the invention using the following Figures, appended for the purposes of illustration and being nonlimiting.

DETAILED DESCRIPTION OF THE INVENTION

Figure 1:
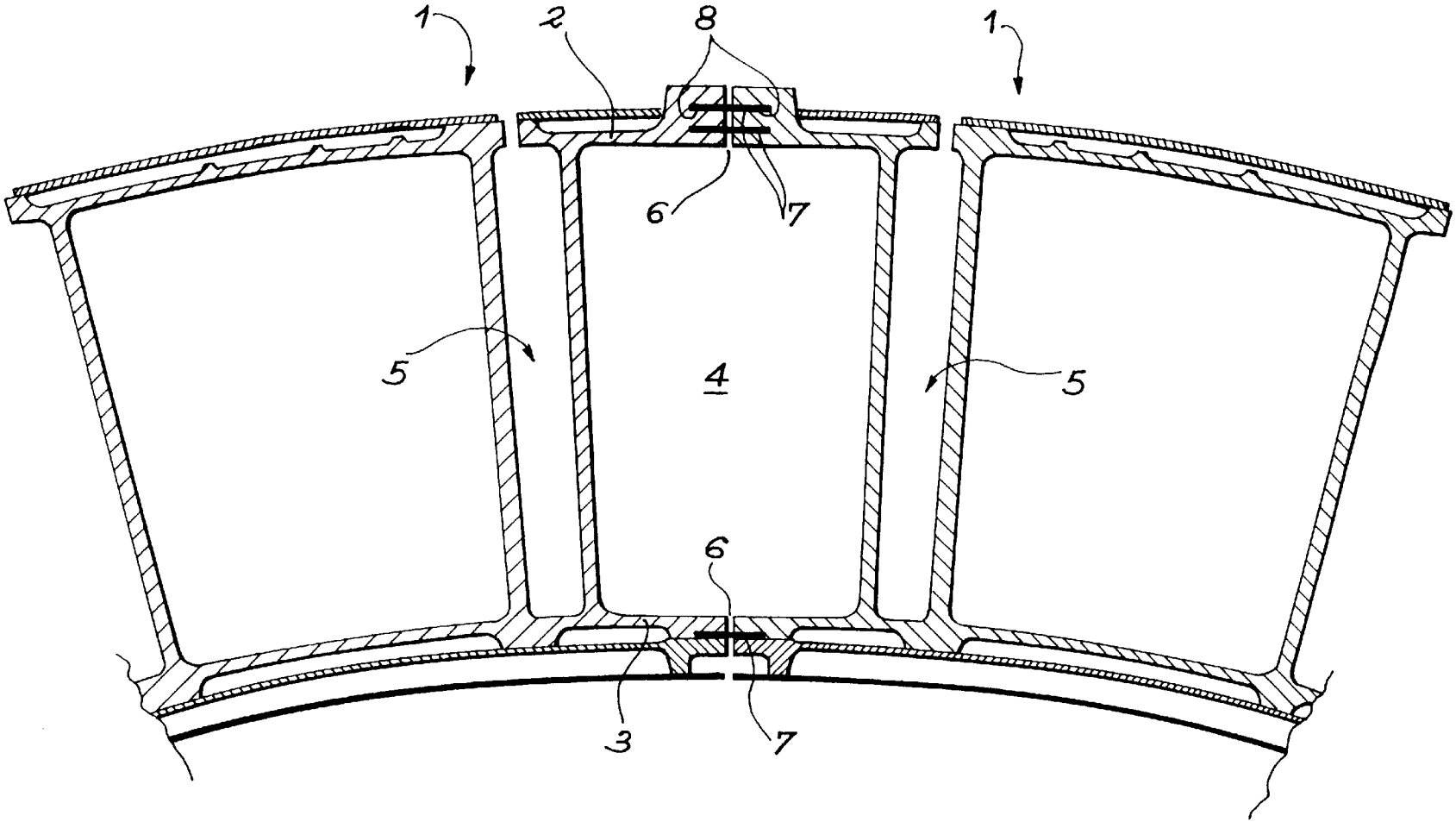
FIGS. 1 and 2 represent the positioning of the invention in a gas turbine engine stator.
Figure 2:
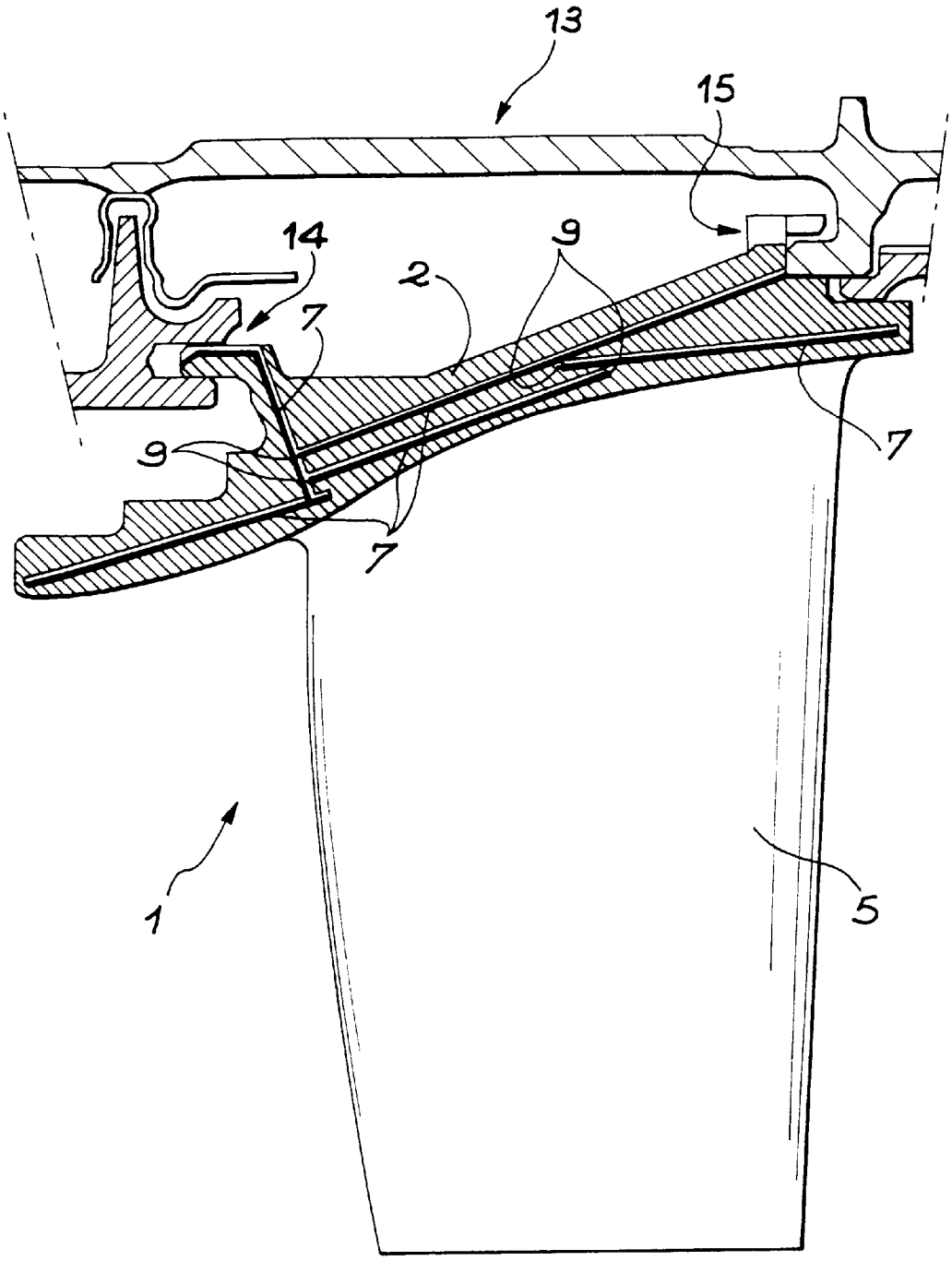

FIG. 1 is a cross-section of a portion of a gas turbine engine which shows a pair of stator sectors 1, each one of which includes an external skin 2, an internal skin 3, the two skins 2 and 3 defining a gas flow stream 4 and being joined by fixed vanes 5, the section of which is hollow. Gaps are located between the sectors 1, and more precisely between their skins 2 and 3. The seal conforming to the invention extends therefore with as many seals as is necessary, across each of the gaps 6 and inside pairs of slots 8 formed in continuation in the sectors 1 opposite one another. FIG. 2, which represents a longitudinal section of the stator, shows that the seals 7 can take up a complicated assembly arrangement in relation to the shape of skins 2 and 3: in practice they constitute a network formed from elements arranged in several broken lines, the ends 9 of which often press upon other seals 7, more or less close to the end of these seals, in such a way that the gases must take a winding route in order to escape through the gaps. It should also be commented that sectors 1 are retained on a single external casing 13 by two systems 14 and 15 with a collar housed in a groove. This arrangement permits assembly of the sectors 1 without their being connected to one another, which would prevent adjustment of the width of the gaps.

Figure 3:
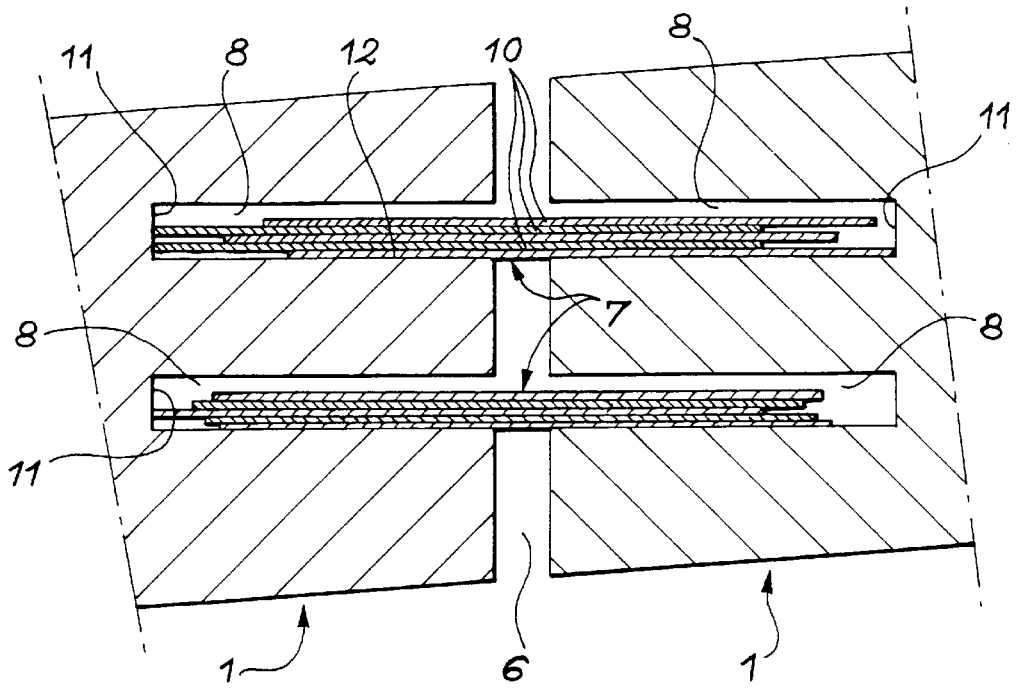
FIGS. 3 and 4 represent the invention itself.

FIG. 3 shows that each of the seals 7 is made up of several thin slabs 10 positioned one on top of the other (without any connection either between them or with the sectors 1) and narrower than the distance between the bottom ends 11 of the extended slots 8, which allows them to slide one upon the other, whatever the deformation or the displacement of the sectors 1 and the vibrations of the machine and to spread out laterally within the slots 8, towards their bottom ends 11. An advantage of this arrangement is that the seals 7 take up an assembly width that is greater than the width of the slabs 10 that make them up, which reduces gas leaks caused by the slabs 10 being circumvented; it is even probable that the thin slabs 10 in the same seal 7 simultaneously touch the far ends 11 of both slots 8 and create an extra barrier to the gases at this place, which would be inconceivable with a single slab unless it be accepted that the single slab would not be compressed and not flex, in such a way that it would no longer be positioned in the slots 8 and would therefore be less efficient for preventing leaks.

A second advantage of the invention is precisely that the thin slabs 10 remain positioned one upon the other and on one of the side walls 12 of the slots 8, on the side where the pressure is least. It can be seen that this arrangement guarantees a large contact surface area between the seal 7 and the side wall 12, that nevertheless forms the path that any leaking gas must take, which explains why the leakage flow rate will be much lower than with previous designs.

The contact with the side wall 12 is even further improved thanks to the low rigidity of the thin slabs 10. This situation is of great value since it allows the thin slabs 10 to deform in order to conform with the actual contours of the side walls 12, even if they have been produced with manufacturing imperfections or are not completely face to face with one another, and even if the thin slabs 10 have been slightly buckled at the start.

Figure 4:
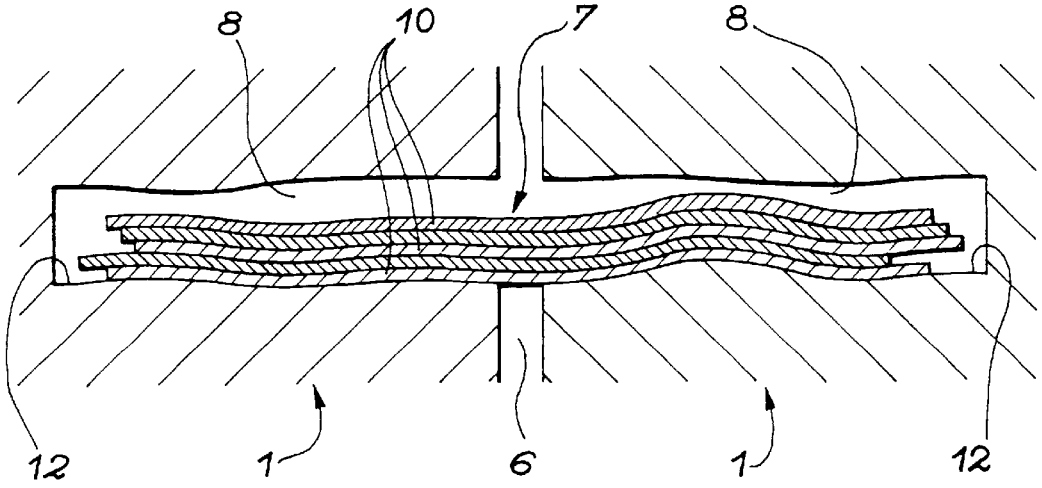

FIG. 4 immediately evokes this advantage, illustrating, in an exaggerated way, the deformations and defects that one can find in the areas around the seal 7: the pressure to which the thin slabs 10 are subjected deforms them in the same manner as the side walls 12.

We claim:

1. A seal running across a gap between two stator sectors of a gas turbine engine, extending within two adjacent reception slots formed in continuation of one another in the two stator sectors and being movable in the adjacent reception slots, comprising:

a stack of thin flexible separate slabs positioned one on the other, in such a way that the slabs can mutually slide over one another while spreading out laterally within the adjacent reception slots without any connection between each of the slabs.

2. A seal according to claim 1, characterised in that the stator sectors are angular sectors being held separately on an external casing of the stator and defining a gas flow stream therebetween.

* * * * *

UNITED STATES PATENT AND TRADEMARK OFFICE

CERTIFICATE OF CORRECTION

PATENT NO. : 5,997,247

DATED : December 7, 1999

INVENTOR(S): Anne-Marie ARRAITZ et al.

It is certified that an error appears in the above-identified patent and that said Letters Patent is hereby corrected as shown below:

On the title page, item [73], the Assignee's name is misspelled. It should be:

-- [73] Assignee: Societe Nationale d'Etude et de Construction de Moteurs d'Aviation "SNECMA", Paris, France--

On the title page, item [30] has been omitted. It should read as follows:

--[30] Foreign Application Priority Data

Jan. 30, 1997 [FR] France.....97 00988--

Signed and Sealed this

Twenty-third Day of January, 2001

*Attest:*

Q. TODD DICKINSON

*Attesting Officer*

*Commissioner of Patents and Trademarks*